US006568977B1

(12) United States Patent
Yu

(10) Patent No.: US 6,568,977 B1
(45) Date of Patent: May 27, 2003

(54) MULTIFUNCTION FOLDABLE FLOAT

(76) Inventor: Pei Hua Yu, 55-09 Van Horn St., Elmhurst, NY (US) 11373

( * ) Notice: Subject to any disclaimer, the term of this patent is extended or adjusted under 35 U.S.C. 154(b) by 0 days.

(21) Appl. No.: 09/681,445

(22) Filed: Apr. 6, 2001

(51) Int. Cl.[7] ..... B63C 9/28
(52) U.S. Cl. ..... 441/125; 441/129
(58) Field of Search ..... 441/125–129, 441/43, 35

(56) References Cited

U.S. PATENT DOCUMENTS 4,135,256 A * 1/1979 Limegrover ..... 4/171
5,439,405 A * 8/1995 Storey et al. ..... 441/127

* cited by examiner

*Primary Examiner*—Ed Swinehart
(74) *Attorney, Agent, or Firm*—Michael L. Greenberg, Esq.; Greenberg & Lieberman

(57) ABSTRACT

A flotation device with six pieces that are removably attached to each other. The six pieces can be rearranged to create a tub and seat a leaky boat or life buoy. The pieces are removably attached to each other by a series of perforations and hook and loop material or ribbon and twine and are constructed of a buoyant foam and water resistant covering which is resistant to tears or rips.

7 Claims, 2 Drawing Sheets

MULTIFUNCTION FOLDABLE FLOAT

BACKGROUND OF INVENTION

Many people in the United States and all over the world choose to go to the shorelines or lakes for relaxation on their breaks from work and school. Often people use flotation devices to enjoy the water at a lake, pool or ocean. There are flotation devices that fit in a circular fashion around children as they learn to swim. There are also life jackets approved by life guard associations and the Coast Guard as flotation devices to be used as life saving devices in case of a boating problems, or swimming difficulties. In the same vein, are life rafts that are self inflatable that are equipped on motor boats. The life saving devices, although pertinent to the field of flotation devices are not related intricately to the field of recreational flotation devices, and thus are not under the same categories as floating beds, inner tubes and the like.

There are many recreational flotation devices on the market. Most are inflatable and created of a thin plastic material that can be easily punctured. Some are in novelty shapes such as fish, or other sea creatures. However as will be shown in the discussion of related art, most flotation devices cannot change shape by having removably attached pieces.

U.S. Pat. No. 3,167,794 issued to Brown, on Feb. 2, 1965 shows a folding yoke life preserver. Brown's invention is unlike the present invention because it is a life saving device, not a recreational flotation device, it is one congruous piece, instead of many pieces that can be rearranged into different configurations, and it is intended to be worn by the user around their neck, not used as a seat, tub or boat.

U.S. Pat. No. 3,268,926 issued to Talalay on Aug. 30, 1966 shows a seat cushion. Talalay's invention is unlike the present invention because it is a life saving device, not a recreational flotation device, it is one congruous piece, instead of many different pieces that can be rearranged to create different shapes, and it would not function as a seat, tub or floating bed as can the present invention.

U.S. Pat. No. 3,727,249 issued to Bonthelius on Apr. 17, 1973 shows a folding yoke life presever. Bonthelius' invention is unlike the present invention because it is a life saving device, not a recreational flotation device, it is one congruous piece instead of many different pieces that can be rearranged to create different shapes, it is intended to be worn by the user, and it would not function as a seat, tub, or floating bed as can the present invention.

U.S. Pat. No. 4,729,331 issued to Eggleston, on Mar. 8, 1988 shows a lightweight inflatable swim raft anchor apparatus. Eggleston's invention is unlike the present invention because it is a flotation bed only, it has a suction device for attachment to the side of a pool, and it does not have removable flotation pieces to create different shapes such as a tub or seat.

U.S. Pat. No. 4,915,662 issued to Kent on Apr. 10, 1990 shows a marine fender and cushion device. Kent's invention is unlike the present invention because it is a seat cushion intended for motor boats, it is not intended to be a floating bed, seat or tub, it does not have removable pieces that can be rearranged to create different shapes, and it is not primarily a flotation device but instead a seat cushion that also has buoyant properties.

U.S. Pat. No. 4,926,781 issued to Bauer on May 22, 1990 shows a portable personal flotation device. Bauer's invention is unlike the present invention because it is a wearable flotation device, it does not have removable pieces that can be rearranged to create a bed, tub or boat, it has a door for entering and exiting the flotation device, and it is made of styrofoam.

U.S. Pat. No. 5,562,514 issued to Rowe on Oct. 8, 1996 shows an individual flotation device. Rowe's invention is unlike the present invention because it does not have removable pieces that can be rearranged to create a tub, a boat, or a seat, and it is intended to be held onto instead of a flotation device that can be sat on.

U.S. Pat. No. 5,725,404 issued to Gomez, on Mar. 10, 1998 shows a floating bed assembly. Gomez' invention is unlike the present invention because it does not have removable pieces that can be rearranged to create a tub, boat or seat, it has telescopic members to change the length of the flotation device, and the pieces of the invention that are buoyant are only beneath the back, head, and feet of the user.

U.S. Pat. No. 5,833,505 issued to Huang on Nov. 10, 1998 shows a multipurpose float. Huang's invention is unlike the preaent invention because it cannot serve as a boat, or tub, the removable pieces are connected by means of screws not ribbon or twine, and it cannot hold the entire body of an adult user for flotation purposes.

U.S. Pat. No. 5,885,123 issued to Clifford on Mar. 23, 1999 shows a flotation device utilizing cylindrical foam tubes. Clifford's invention is unlike the present invention because it has sleeves to create different styles of floats instead of using ribbon or twine, and encompasses more individual pieces than the present invention.

U.S. Pat. No. 6,045,423 issued to Silvia on Apr. 4, 2000 shows a pool chair. Silvia's invention is unlike the present invention because it is one congruous piece instead of separate components that can be rearranged to create different embodiments, and it cannot function as a tub, or boat flotation device.

Therefore a need has been established for a flotation device that has pieces that can be rearranged to create a seat, tub, or boat flotation device, and is intended for recreational use.

SUMMARY OF INVENTION

The present invention is a flotation device with removable pieces to create different shapes for the user to recline upon. The present invention is a flotation device with six separate parts that can be attached to one another by means of ties. Five of the six separate pieces are filled with a buoyant foam. The last of the sections is constructed of netting. The netting section has three sections that fold upon each other. Each section is secured to one another by use of ribbon and hooks.

The present invention can be assembled to be a floating tub, a leaky boat, or a seat. The present invention can also be a bed that the user can recline upon for sunbathing or relaxation. The tub and boat embodiments of the present invention create a situation in which the user can still enjoy the water, and stay dryer than in the bed embodiment. The present invention can also be used with each piece separately as a separate flotation device. The different assemblies are explained in greater detail in the following description.

DETAILED DESCRIPTION

The present invention is a flotation device that can be assembled in at least three distinct shapes, a tub, a seat or a life buoy. The present invention has six separate parts which are attached to each other by means of ribbon or twine to create different flotation uses. The six separate parts are constructed of a foam interior and a water resistant covering.

Figure 1:
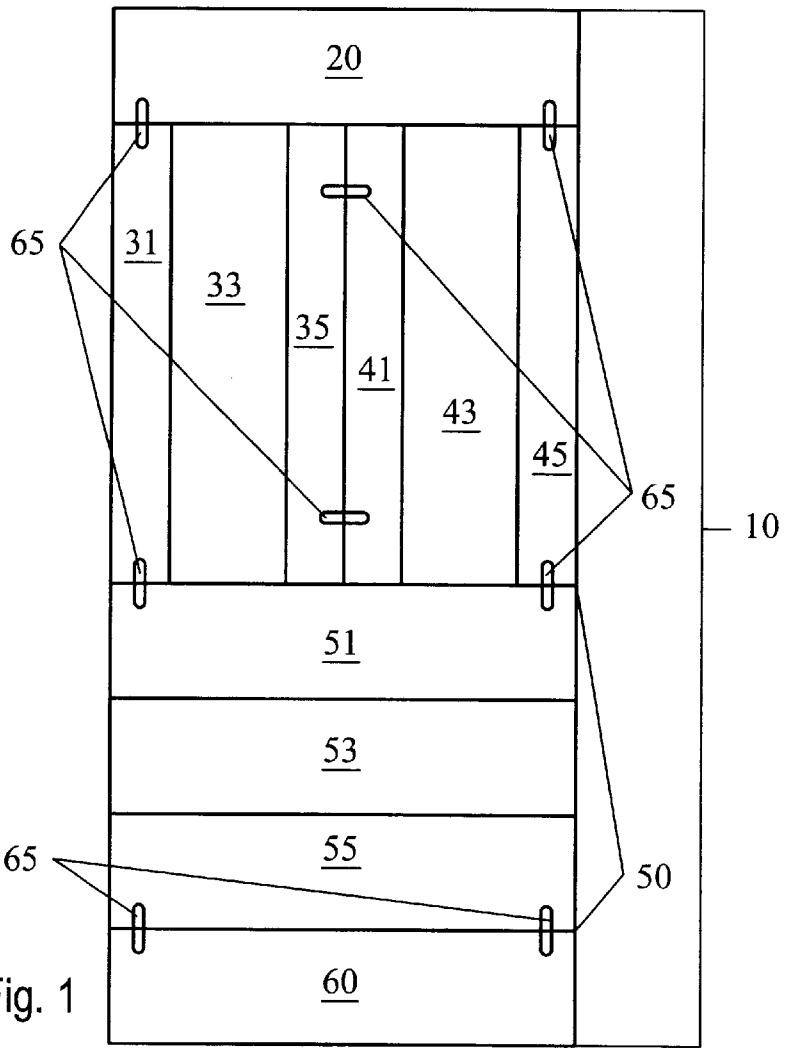
FIG. 1 is a top view of a bed embodiment of the present invention.

FIG. 1 shows an embodiment of the present invention as assembled in the rectangular shape or as a bed. The flotation apparatus (10) is assembled in this embodiment with a first large rectangular section (20) placed in a horizontal fashion at the upper portion. Immediately below the first large rectangular section are first (30) and second (40) tri-fold sections that are removably attached to the first large rectangular section (20) by use of hook and loop material. The first tri-fold section (30) is in this embodiment placed directly below and to the left section of the first large rectangular section (20) in a vertical fashion, perpendicular to the first large rectangular section (20). The three permanently attached sections of first tri-fold section (30) are shown as first left permanent section (31), first middle permanent section (33) and first right permanent section (35). Upon storage of the flotation apparatus (10), first left permanent section (31) of the first tri-fold section (30) can be easily folded upon first middle permanent section (33) and meet first right permanent section (35) as it also is folded upon first middle permanent section (33).

The second tri-fold section (40) in this embodiment is removably attached to the bottom right section of the first large rectangular section (20). The second tri-fold region has a second left permanent section (41), second middle permanent section (43) and second right permanent section (45) that are of the same dimensions as the first left permanent section (31), first middle permanent section (33), and first right permanent section (35) of the first tri-fold section (30) of the flotation apparatus (10). The second tri-fold region (40) is easily folded for storage in the same manner as the first tri-fold section (30).

Directly below the first (30) and second (40) tri-fold sections of the flotation apparatus (10) in this embodiment is a third tri-fold section (50) which is removably connected to first (30) and second (40) tri-fold sections by hook and loop material. The third tri-fold section (50) is fashioned of three large lower rectangular sections (51,53,55) that are each of the same dimensions as the first large rectangular section (20). The third tri-fold section (50) can be folded in accordion fashion for easy storage. In this embodiment of the flotation apparatus (10) the third tri-fold section (50) is attached in a horizontal and perpendicular manner to the first (30) and second (40) tri-fold sections. Removably attached to the bottom of the third tri-fold region (50) is the second large rectangular section (60).

In short, for all the embodiments of the present invention, hook and loop type material is provided so that different section can connect. In the first embodiment, shown in FIG. 1, hook and loop type material allows the first large rectangular section (20) connects to both the first (30) and second (40) tri-fold sections of the flotation apparatus (10). Hook and loop type material is also provided so that the first (30) and second (40) tri-fold sections connect to one another along the midline (41). Hook and loop type material is further provided so that the third tri-fold region (50) connects to the first (30) and second (40) tri-fold sections. Lastly, hook and loop type material is provided so that second large rectangular section (60) connects to third tri-fold region (50). The placement of the hook and loop type material is preferred so that the present invention does not become detached during use; that is, hook and loop type material should generally be placed at points of contact between the connecting pieces. Hook and loop type material can also be located on different pieces so that the pieces remain together when they are folded upon one another for storage. Reinforcement connection pieces (65) are distributed at critical weight points along the present invention. Reinforcement connection pieces (65) can be hooks, belts, or any other suitable fastening means more reliable than hook and loop type material.

Figure 2:
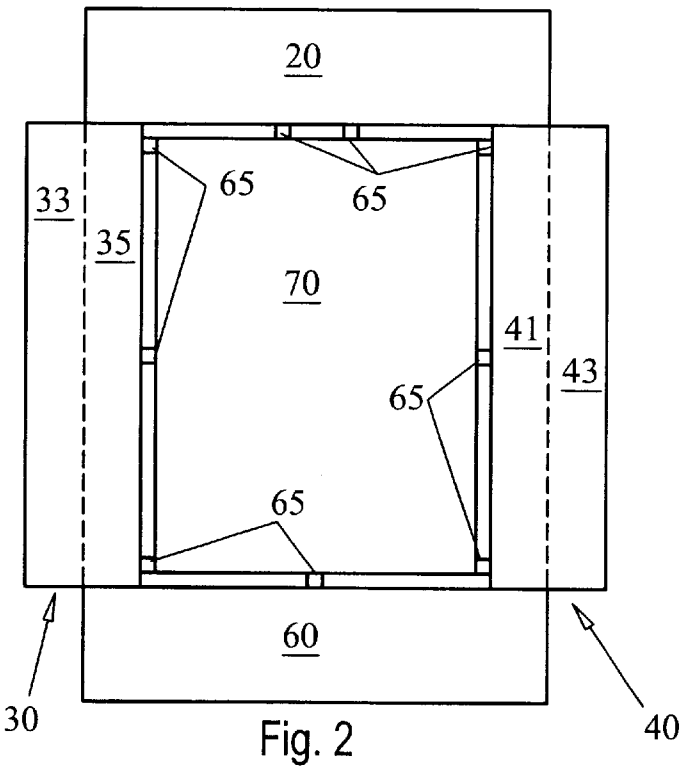
FIG. 2 is a top view of a leaky boat embodiment of the present invention.

FIG. 2 shows the present invention in the leaky boat configuration. This embodiment is referred to as the leaky boat configuration because it has the netting region (70) as the middle of the embodiment. The netting region (70) allows water to enter the boat, so the user is continually cooled by the water. The netting region (70) is attached to the first (30) and second (40) tri-fold sections, and the first (20) and second large rectangular section (60) by means of reinforcement connection pieces (65). The reinforcement connection pieces (65) can be easily adjusted to create a tight fit or a loose fit of the netting region (70). The third tri-fold section (50) is not shown in FIG. 2 because it has been folded upon itself and sits under second large rectangular section (60).

As shown in FIG. 2, the first (30) and second (40) tri-fold sections are folded over upon themselves. The first left permanent section (31) is not seen in FIG. 2 because it is underneath first right permanent section (35) and connected to netting section (70). The first middle permanent section (33) is disposed between first left permanent section (31) and first right permanent section (35), and first right permanent section (35) is removably attached to the netting section (70), with the first permanent middle section (33) on the outermost part of the leaky boat configuration. The second tri-fold section (40) is removably attached to the netting region (70) at the second left permanent section (41) and the second right permanent section (45) not shown in FIG. 2 because it is under second left permanent section (41)—so that the second right middle section (43) is the outermost edge of the leaky boat configuration on the right side. The first large rectangular section (20) and the second large rectangular region (60) create a head and foot of the leaky boat configuration.

Figure 3:
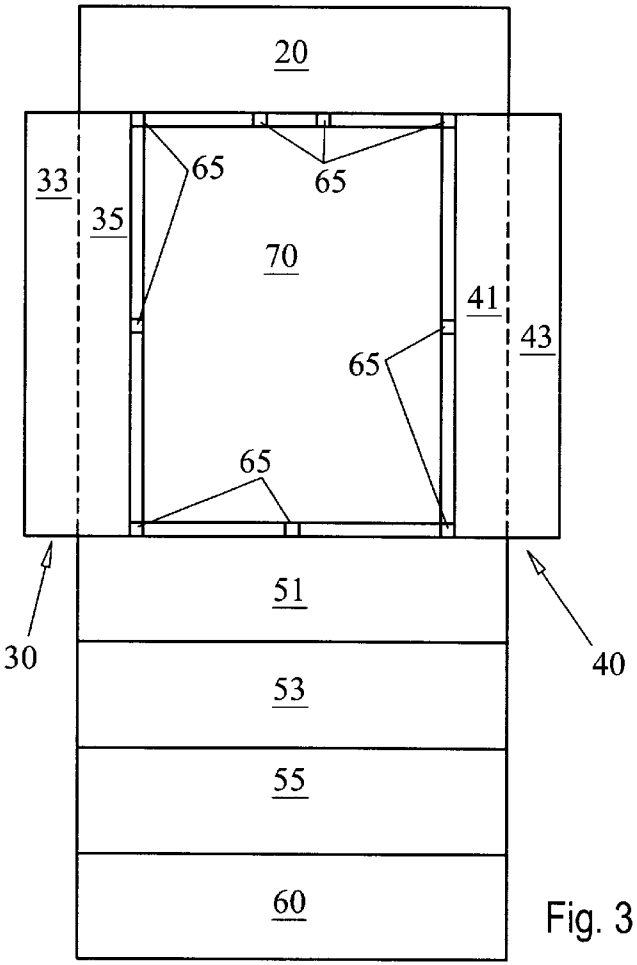
FIG. 3 is a top view of the present invention as a second bed embodiment.

FIG. 3 shows a separate embodiment of the present invention in which the netting section (70) is removably attached to the first (30), second (40) and third (50) tri-fold sections, as well as the first large rectangular section (20) creating a tub or seat embodiment of the present invention. The third tri-fold section (50) is extended to full length, allowing the user to stretch their legs onto three large lower rectangular sections (51,53,55) of the third tri-fold section (50). The second large rectangular section (60) is removably attached to the third large lower rectangular section (55) of the third tri-fold section (50) to create a pillow section for the user's feet.

As in FIG. 2, the first (30) and second (40) tri-fold sections are removably attached to the left and right of the netting section (70) by reinforcement connection pieces (65). The first large rectangular region (20) creates a pillow section for the user to rest their head. This embodiment is the tub version of the present invention.

Figure 4:
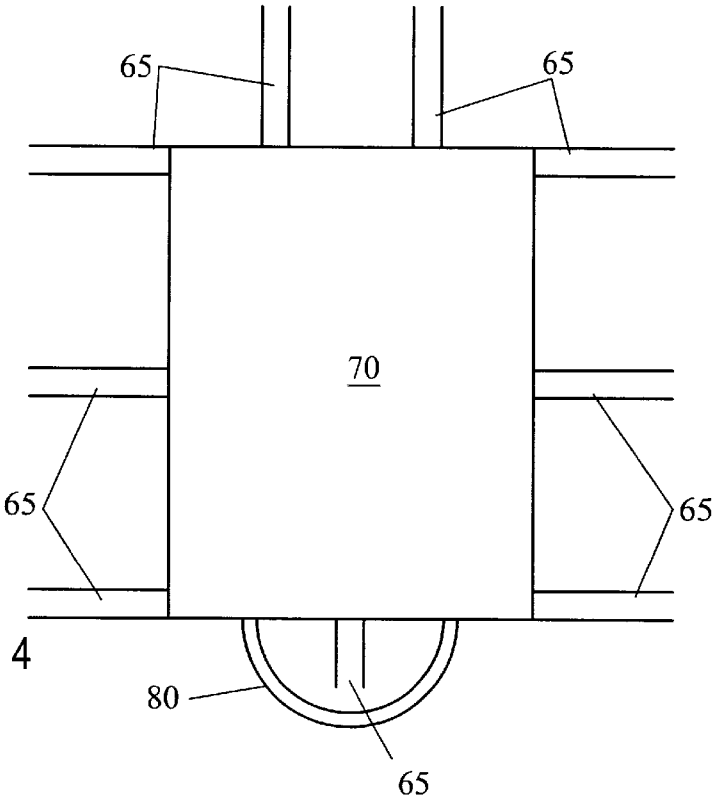
FIG. 4 is an environmental view of the present invention as folded and contained for storage.

FIG. 4 shows the netting region (70) used as a carrying case for the separate pieces of the present invention. Reinforcement connection pieces (65) can be closed around the pieces and hook and loop type material is used as in other embodiments to keep the different sections together. Also shown in FIG. 4, is the handle (80) for ease in carrying the present invention. In other embodiments of the present invention, the handle (80) can either be detached or be simply left to hang. The handle is in communication with first left permanent section (31) and/or second right permanent section (45). A zipper (not shown) may be disposed on the present invention to work in together with hook and loop type material to keep the different sections together and allow them to form a bag shape in combination with the netting region (70).

Figure 5:
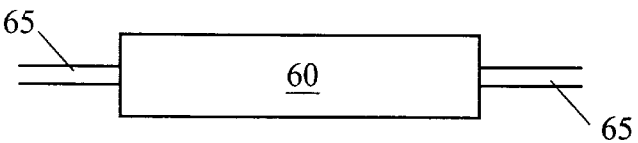
FIG. 5 shows the present invention as a life buoy.

FIG. 5 shows that the second large rectangular section (60) can be used independently as a life buoy; that is, it can simply be detached from the rest of the present invention. The user can tie the reinforcement connection pieces (65) at each side of the second large rectangular section (60) around the user's waist, and second large rectangular section (60) becomes a flotation device for those who need assistance swimming.

The present invention is not limited to the embodiment described above, but encompasses any and all of the embodiments in the following claims.

What is claimed is:

1. A flotation device, comprising:

three tri-fold sections;

two large rectangular sections, removably attached to said three tri-fold sections; and a square section of netting, disposed adjacent to said three tri-fold sections, wherein adjustable straps hold said square section of netting wrapped around said three tri-fold sections and said two large rectangular sections.

2. A flotation devices comprising:

three tri-fold sections;

two large rectangular sections, removably attached to said three tri-fold sections;

a square section of netting, disposed adjacent to said three tri-fold sections, wherein adjustable straps hold said square section of netting wrapped around said three tri-fold sections and said two large rectangular sections; and a handle attached to said square section of netting for ease in carrying the flotation device.

3. A flotation device as in claim 2, wherein said adjustable straps allow said one of three tri-fold sections to be folded upon itself and secured for storage or transport.

4. A flotation device comprising:

three tri-fold sections;

two large rectangular sections, removably attached to said three tri-fold sections;

a square section of netting, disposed adjacent to said three tri-fold sections, wherein adjustable straps provide a means for elongating or shortening distance of said square section of netting from said three tri-fold sections, and said two large rectangular sections; and a handle attached to said square section of netting for ease in carrying the flotation device.

5. A flotation device as in claim 4, wherein the distance of said square section of netting and said adjustable straps allow the user to adjust the amount that they are seated in the water.

6. A flotation device as in claim 5, wherein said square section of netting and said adjustable straps can be attached to varying numbers of the available said three tri-fold sections, and said two large rectangular section.

7. A flotation device as in claim 6, wherein the varying numbers of the available said three tri-fold sections, and said two large rectangular sections determine the amount of buoyancy, and the depth of the user seated on said square section of netting.

* * * * *